US010305213B1

(12) United States Patent
Hirakawa et al.

(10) Patent No.: US 10,305,213 B1
(45) Date of Patent: May 28, 2019

(54) TERMINAL CONNECTING STRUCTURE AND FEMALE TERMINAL

(71) Applicant: YAZAKI CORPORATION, Tokyo (JP)

(72) Inventors: Takayoshi Hirakawa, Shizuoka (JP); Yasuhiro Tanaka, Shizuoka (JP); Kengo Machida, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/024,651

(22) Filed: Jun. 29, 2018

(30) Foreign Application Priority Data

Mar. 1, 2018 (JP) ..... 2018-036132

(51) Int. Cl.
*H01R 13/187* (2006.01)
*H01R 13/35* (2006.01)
*H01R 13/11* (2006.01)

(52) U.S. Cl.
CPC ..... *H01R 13/187* (2013.01); *H01R 13/111* (2013.01); *H01R 13/35* (2013.01)

(58) Field of Classification Search
CPC ..... H01R 13/35; H01R 13/111; H01R 13/187
See application file for complete search history.

(56) References Cited

U.S. PATENT DOCUMENTS 3,120,989 A * 2/1964 Solorow ..... H01R 13/187 439/843
7,249,983 B2 * 7/2007 Meyer ..... H01R 4/185 439/851
7,591,694 B2 * 9/2009 Osada ..... H01R 4/185 439/852
9,748,685 B2 * 8/2017 Oba ..... H01R 4/023 439/851
10,122,109 B1 * 11/2018 Hirakawa ..... H01R 13/113 439/851
2016/0020541 A1 * 1/2016 Takamura ..... H01R 13/111 439/816
2016/0181706 A1 6/2016 Nakano et al.
2018/0337479 A1 * 11/2018 Machida ..... H01R 4/184 439/851

FOREIGN PATENT DOCUMENTS

JP 2013-187170 A 9/2013
JP 2016-119292 A 6/2016

* cited by examiner

*Primary Examiner* — Tho D Ta
(74) *Attorney, Agent, or Firm* — Kenealy Vaidya LLP

(57) ABSTRACT

A terminal connecting structure includes a male terminal having a plated columnar rod portion, a female terminal having a cylindrical portion configured to receive the rod portion of the male terminal therein, and an elastic member attached to the cylindrical portion of the female terminal. The elastic member energizes the rod portion toward an inner surface of the cylindrical portion when the rod portion is inserted into the cylindrical portion. The female terminal has a plurality of projection portions protruding inward from respective regions located at both sides of a central portion of the inner surface of the cylindrical portion as seen from a front view. A tip end of each of the plurality of projection portions has a curved surface which is concave toward an outer side of the cylindrical portion.

8 Claims, 4 Drawing Sheets

TERMINAL CONNECTING STRUCTURE AND FEMALE TERMINAL

CROSS REFERENCE TO RELATED APPLICATIONS

This application is based on Japanese Patent Application (No. 2018-036132) filed on Mar. 1, 2018, the contents of which are incorporated herein by reference.

BACKGROUND OF THE INVENTION

1. Field of the Invention

The present invention relates to a terminal connecting structure and a female terminal.

2. Description of the Related Art

Conventionally, there has been proposed a terminal connecting structure including a male terminal having a columnar rod portion, a female terminal having a cylindrical portion into which the rod portion of the male terminal is inserted, and an elastic member attached in the cylindrical portion of the female terminal. The rod portion of the male terminal is held in the cylindrical portion of the female terminal by an elastic force of the elastic member. In such a terminal connecting structure, the elastic member includes two coaxially arranged ring members and a plurality of plate springs which connect the two ring members and are curved inward and arranged circumferentially. As a result of being inserted into the cylindrical portion of the female terminal, the rod portion of the male terminal is held while being energized toward a central axis side of the cylindrical portion by the plurality of plate springs of the elastic member.

However, in such a structure, when vibration exceeding a pressing force of the plurality of plate springs of the elastic member occurs, a relative movement of the male terminal with respect to the female terminal cannot be suppressed, causing contact sliding between the terminals, which consequently leads to an increase in resistance value due to contact wear.

Therefore, a terminal connecting structure as described in JP-A-2016-119292 has been proposed. In this structure, a female terminal has a plurality of projection portions protruding inward from an open side (an open side of a barrel portion provided at a rear end of the female terminal) on an inner wall of a cylindrical portion. Specifically, the plurality of projection portions include two projection portions provided on the open side of a tip end side in the cylindrical portion and two projection portions provided on the open side of a rear side in the cylindrical portion. Further, the elastic member is provided with a plurality of plate springs arranged only in a half circumferential shape, and energizes a rod portion of a male terminal to the open side of the cylindrical portion provided with the plurality of projection portions. Since the projection portions has no elastic force, a movement of the rod portion of the male terminal can be regulated by the projection portions, and a possibility of increase in resistance value due to contact sliding can be reduced.

However, in the terminal connecting structure described in JP-A-2016-119292, the plurality of projection portions may exert a wedge effect so that a contact load on the rod portion of the male terminal is increased into the female terminal. For this reason, there is a possibility that the plating of the rod portion is excessively scraped by contact with the projection portion when the male terminal is inserted into the female terminal.

SUMMARY OF THE INVENTION

The present invention has been made to solve such conventional problems, and an object thereof is to provide a terminal connecting structure and a female terminal capable of reducing a plating-scraping amount of a rod portion of a male terminal when the male terminal is inserted into the female terminal.

A terminal connecting structure according to the present invention includes a male terminal having a plated columnar rod portion, a female terminal having a cylindrical portion configured to receive the rod portion of the male terminal therein, and an elastic member attached to the cylindrical portion of the female terminal. The elastic member energizes the rod portion of the male terminal toward an inner surface of the cylindrical portion when the rod portion of the male terminal is inserted into the cylindrical portion of the female terminal. The female terminal has a plurality of projection portions protruding inward from respective regions located at both sides of a central portion of the inner surface of the cylindrical portion as seen from a front view. A tip end of each of the plurality of projection portions has a curved surface which is concave toward an outer side of the cylindrical portion.

According to the terminal connecting structure of the present invention, since the tip end of each of the projection portions has the curved surface which is concave toward the outer side of the cylindrical portion, a surface pressure of the projection portion with respect to the rod portion of the male terminal can be lowered, and the plating-scraping amount of the rod portion can be reduced accordingly when the male terminal is inserted into the female terminal.

In the terminal connecting structure according to the present invention, a radius of curvature of the curved surface of the tip end of each of the projection portion is larger than a radius of curvature of a circumferential surface of the rod portion of the male terminal in a cross section orthogonal to an axis of the cylindrical portion.

According to the terminal connecting structure, the radius of curvature of the curved surface of the tip end of the projection portion is larger than the radius of curvature of the circumferential surface of the rod portion. Here, if both of the radius of curvature of the curved surface of the tip end of each of the projection portions and the radius of curvature of the circumferential surface of the rod portion of the male terminal are designed to be the same for example, the radius of curvature of the curved surface of the tip end of the projection portion may be smaller than the radius of curvature of the circumferential surface of the rod portion due to dimensional tolerance. At this time, there is a concern that the tip end of each projection portion acts like a two-point sharp shape. However, since the radius of curvature of the curved surface of the tip end of the projection portion is larger than the radius of curvature of the circumferential surface of the rod portion, such a concern does not occur and the plating-scraping amount of the rod portion can be appropriately reduced.

Further, in the terminal connecting structure according to the present invention, the elastic member includes two half-ring-shaped frame members spaced apart from each other and located on a tip end side and a rear end side of the cylindrical portion, and includes a plurality of plate springs curved inward of the cylindrical portion and connecting the two frame members. The plurality of projection portions include two or more projection portions provided at a tip end side and a rear end side of the cylindrical portion respectively. The frame member on the rear end side is in contact with or close to the projection portion on the rear end side of the cylindrical portion of the female terminal.

According to the terminal connecting structure, the frame member on the rear end side of the elastic member is in contact with or close to the projection portion on the rear end side. For this reason, the elastic member is restricted from moving to one side by the projection portion on the rear end side, and can hardly detach from one side of the cylindrical portion even before the male terminal is inserted. Therefore, an assembling property of the elastic member to the female terminal can be improved.

Also, for example, a width of the projection portions provided at the tip end side is larger than that of the projection portions provided at the rear end side in a peripheral direction of the cylindrical portion.

Also, for example, a front end face of the cylindrical portion has a groove extending toward an outer side of the cylindrical portion while expanding a width of the groove, the elastic member has a tongue piece with a shape matching with the groove, and the tongue piece is configured to be fit in the groove.

A female terminal according to the present invention includes a cylindrical portion configured to receive a plated columnar rod portion of a male terminal, and a plurality of projection portions protruding inward from respective regions located at both sides of a central portion of an inner surface of the cylindrical portion as seen from a front view. When an elastic member is attached to the cylindrical portion of the female terminal and the rod portion of the male terminal is inserted into the cylindrical portion of the female terminal, the elastic member energizes the rod portion of the male terminal toward an inner surface of the cylindrical portion. A tip end of each of the plurality of projection portions has a curved surface which is concave toward an outer side of the cylindrical portion.

According to the female terminal of the present invention, since the tip end of each of the projection portion has the curved surface which is concave toward the outer side of the cylindrical portion, the surface pressure of the projection portion on the rod portion of the male terminal can be lowered, and the plating-scraping amount of the rod portion can be reduced accordingly when the male terminal is inserted into the female terminal.

According to the present invention, there is provided a terminal connecting structure and a female terminal capable of reducing a plating-scraping amount of a rod portion of a male terminal when the male terminal is inserted into the female terminal.

DETAILED DESCRIPTION OF THE EXEMPLARY EMBODIMENTS

Hereinafter, the present invention will be described in accordance with preferred embodiments. The present invention is not limited to the embodiments described below and can be appropriately modified without departing from the spirit of the present invention. In addition, in the embodiments described below, there are places where illustration and explanation of a part of the configuration are omitted, and for the details of the omitted technique, it goes without saying that known or well-known techniques are appropriately applied within a range not inconsistent with the contents described below.

Figure 1:
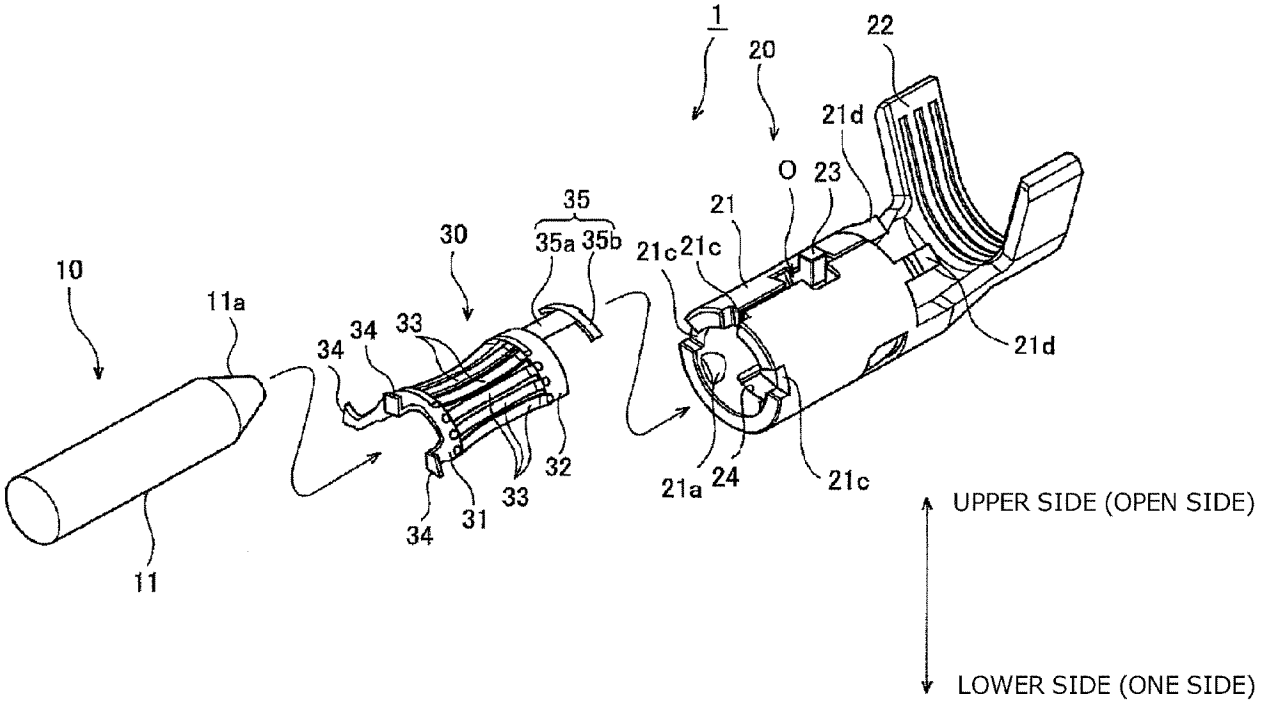
FIG. 1 is a perspective view of a terminal connecting structure according to a first embodiment of the present invention.

FIG. 1 is a perspective view of the terminal connecting structure according to the first embodiment of the present invention. As shown in FIG. 1, a terminal connecting structure 1 according to the present embodiment includes a male terminal 10, a female terminal 20 and an elastic member 30.

The male terminal 10 is made of a conductive metal material and is a so-called round pin type terminal. The male terminal 10 has a columnar rod portion 11 and a barrel portion (not shown) connected to the rod portion 11 and to which a conductor portion such as an electric wire is crimped. Incidentally, the male terminal 10 may be provided with a bolt fastening portion or the like in place of the barrel portion.

An outer diameter of the rod portion 11 is smaller than an inner diameter of a cylindrical portion 21 of the female terminal 20, and the rod portion 11 is configured to be inserted into the cylindrical portion. A tip end 11*a* of the rod portion 11 has a taper shape so as to be smoothly inserted into the cylindrical portion 21. Further, in the present embodiment, the male terminal 10 (at least the rod portion 11) is plated.

The female terminal 20 is made of a conductive metal material, and has a cylindrical portion 21 into which the rod portion 11 of the male terminal 10 is inserted, and a barrel portion 22 connected to the cylindrical portion 21 and to which a conductor portion such as an electric wire is crimped. Incidentally, like the male terminal 10, the female terminal 20 may also be provided with a bolt fastening portion or the like in place of the barrel portion 22.

Here, based on the fact that the female terminal 20 is formed by punching and then bending a metal plate, an opening O extending in a longitudinal direction of the cylindrical portion 21 is formed at an upper (an open side of the barrel portion 22) end portion of the cylindrical portion 21. Further, a stabilizer 23 for preventing erroneous insertion of the female terminal 20 in a rotational direction is formed at the upper end portion of the cylindrical portion 21 with respect to a connector accommodating the female terminal 20. In addition, a through hole 24 into which a protrusion for preventing the female terminal 20 accommodated in the connector from falling out of the connector is fitted is formed at a lower tip end side in the cylindrical portion 21 of the female terminal 20.

The elastic member 30 is made of a conductive or nonconductive material such as metal or resin and attached in the cylindrical portion 21 of the female terminal 20. The elastic member 30 is attached to an upper part in the cylindrical portion 21. When the rod portion 11 of the male member 10 is inserted into the cylindrical portion 21 of the female terminal 20, the elastic member 30 energizes and holds the rod portion 11 to a lower part (one side) of the inner surface of the cylindrical portion 21 by an elastic force.

Figure 2:
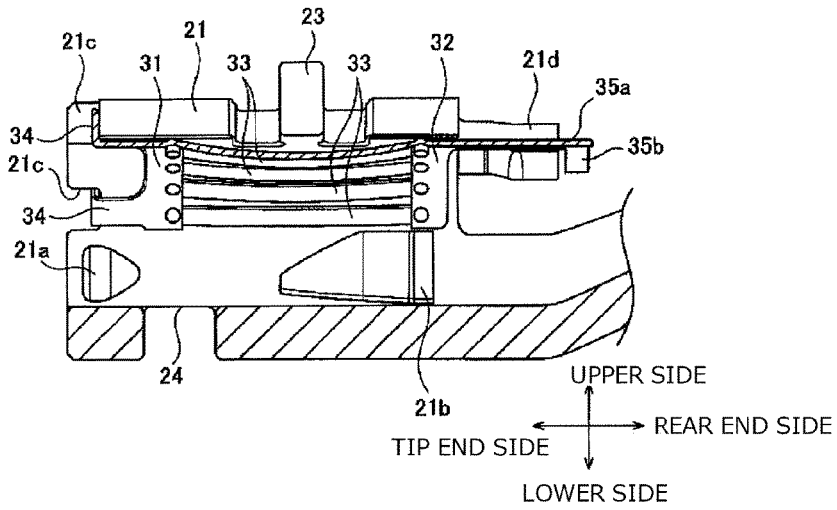
FIG. 2 is a cross-sectional view of the terminal connecting structure in a state that an elastic member shown in FIG. 1 is attached in a cylindrical portion.
Figure 3:
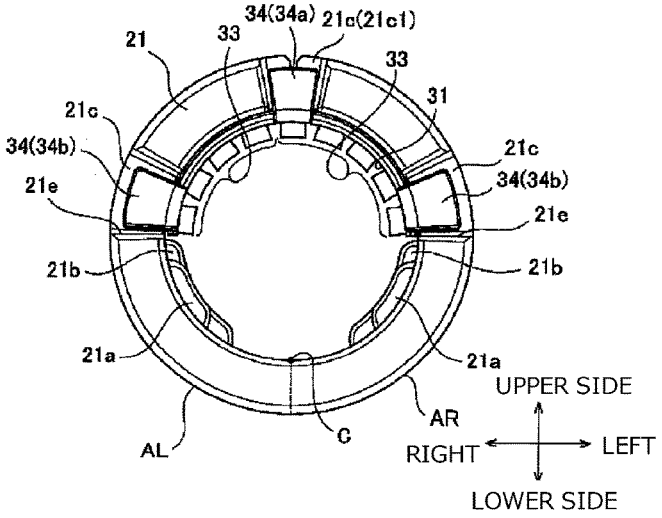
FIG. 3 is a front view of the terminal connecting structure in a state that the elastic member shown in FIG. 1 is attached in the cylindrical portion.
Figure 4:
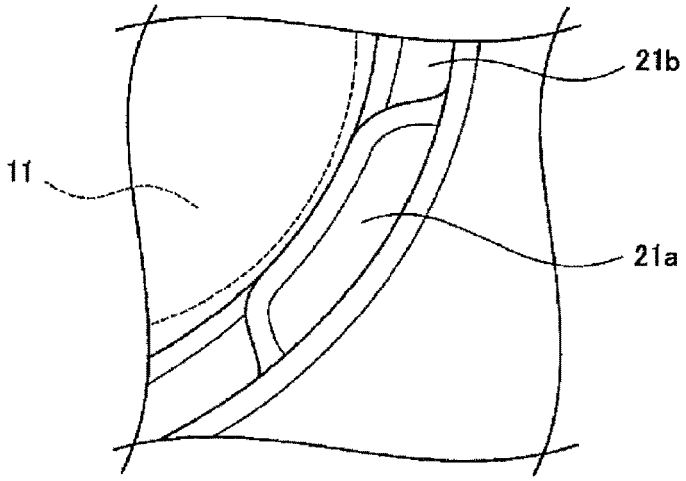
FIG. 4 is a partially enlarged view of the terminal connecting structure shown in FIG. 3.
Figure 5:
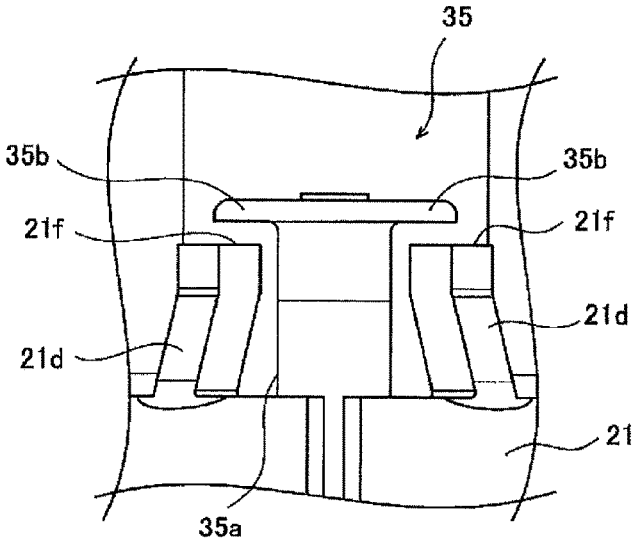
FIG. 5 is a top view showing a rear end side of the elastic member shown in FIG. 1 when being attached in the cylindrical portion.

Hereinafter, the female terminal 20 and the elastic member 30 will be described in detail with reference to FIGS. 1 to 5. FIG. 2 is a cross-sectional view of the terminal connecting structure when the elastic member 30 shown in FIG. 1 is attached in the cylindrical portion 21, and FIG. 3 is a front view of the terminal connecting structure when the elastic member 30 shown in FIG. 1 is attached in the cylindrical portion 21. FIG. 4 is a partially enlarged view of the terminal connecting structure shown in FIG. 3. FIG. 5 is a top view showing a rear end side of the elastic member 30 shown in FIG. 1 when being attached in the cylindrical portion 21.

As shown in FIGS. 1 to 3, the female terminal 20 includes a plurality of projection portions 21*a*, 21*b* protruding inward from an inner wall of the cylindrical portion 21. The plurality of projection portions 21*a*, 21*b* are formed by stamping from an outer surface of the cylindrical portion 21 for example, and include a tip end side projection portion 21*a* formed at a lower part at a tip end side of the female terminal 20, and a rear end side projection portion 21*b* formed at a lower part at a rear end side of the female terminal 20.

The tip end side projection portions 21*a* are respectively formed in regions sandwiching a central portion C at the lower part of the female terminal 20. The lower direction, in which a direction from the upper part to the lower part of the female terminal 20, is same as an energizing direction of the elastic member 30. That is, two tip end side projection portions 21*a* are respectively provided in a right region AR and a left region AL which are adjacent to both sides of the central portion C as seen from the front view. Similarly, two rear end projection portions 21*b* are also respectively provided in the right region AR and the left region AL. Incidentally, the rear end side projection portions 21*b* are formed wider than the tip end side projection portions 21*a* in a circumferential direction of the cylindrical portion 21.

The elastic member 30 includes two half-ring-shaped frame members 31, 32 arranged coaxially in an axis direction of the cylindrical portion 21 and a plurality of plate springs 33. The two half-ring-shaped frame members 31, 32 are disposed to be spaced apart from each other on the tip end side and the rear end side of the female terminal 20, and formed as a first frame member (tip end side frame member) 31 on the tip end side and a second frame member (rear end side frame member) 32 on the rear end side. The plurality of plate springs 33 are spring members each having a shape curved to an inner side of the cylindrical portion 21 (inwardly convex) and are arranged in a half circumference so as to connect the two frame members 31, 32.

The plurality of plate springs 33 of the elastic member 30 press the rod portion 11 toward the plurality of projection portions 21*a*, 21*b* when the rod portion 11 of the male terminal 10 is inserted into the cylindrical portion 21. Therefore, the terminal connecting structure 1 according to the present embodiment achieves a strong holding force by using the wedge effect.

Further, as shown in FIGS. 2 and 3, a tip end of each of the plurality of projection portion 21*a*, 21*b* according to the present embodiment has a curved surface which is concave toward an outer side of the cylindrical portion 21. In the terminal connecting structure 1 according to the present embodiment, the stronger holding force can be achieved by using the wedge effect, but an insertion force of the male terminal 10 into the female terminal 20 is also increased due to the wedge effect. For this reason, there is a possibility that the plating of the rod portion 11 is excessively scraped by the plurality of projection portions 21*a* and 21*b*. However, a plating-scraping amount can be reduced since the tip end of each of the projection portions 21*a*, 21*b* has the curved surface which has the concave toward the outer side of the cylindrical portion 21.

Particularly, as shown in FIG. 4, in a cross section (the same as the front view) orthogonal to an axis of the cylindrical portion 21, a radius of curvature of the curved surface of the tip end of each of the plurality of projection portions 21*a*, 21*b* is larger than a radius of curvature of a circumferential surface of the rod portion 11 of the male terminal 10. The radius of curvature of the curved surface of each of the projection portions 21*a*, 21*b* is designed to be larger than that of the rod portion 11 even if dimensional tolerance is taken into consideration. Here, if both of the radius of curvature of the curved surface of the tip end of each of the projection portions 21*a*, 21*b* and the radius of curvature of the circumferential surface of the rod portion 11 of the male terminal 10 are designed to be the same, the radius of curvature of the curved surface of the tip end of each of the projection portions 21*a*, 21*b* may be smaller than the radius of curvature of the circumferential surface of the rod portion 11 due to the dimensional tolerance. In this case, there is a concern that each tip end of the projection portions 21*a*, 21*b* acts like a sharp shape with respect to the rod portion 11. However, in a case where the radius of curvature of the curved surface of the tip end of each of the projection portions 21*a*, 21*b* is designed to be larger than the radius of curvature of the circumferential surface of the rod portion 11 even if the dimensional tolerance is taken into consideration, such a concern does not occur and the plating-scraping amount of the rod portion 11 can be appropriately reduced.

Further, the female terminal 20 and the elastic member 30 are described in detail with reference to FIGS. 1 to 5.

The female terminal 20 has a plurality of (three) grooves 21*c* on an upper region of a front end face of the cylindrical portion 21 (see FIGS. 1 to 3). Each of the plurality of grooves 21*c* has a taper shape expanding in its width toward the outer side of the cylindrical portion 21. Further, the female terminal 20 includes pillar members 21*d* extending further from a rear end face toward the rear end side of the female terminal (see FIGS. 1, 2 and 5). Two pillar members 21*d* have left-right symmetrically shapes in the upper part of the cylindrical portion 21. Each of the pillar members 21*d* is slightly bent toward the inner side of the cylindrical portion 21.

As shown in FIGS. 1 to 3, the elastic member 30 includes a plurality of (three) tongue pieces 34 protruding from the first frame member 31 to the tip end side. The three tongue pieces 34 are provided at the positions in the circumferential direction so as to correspond to an arrangement of the three grooves 21*c*. Further, each tip end side of the tongue pieces 34 is bent at a right angle (toward the outer side of the cylindrical portion 21) so as to fit in the grooves 21*c*. For this reason, even if a force toward the rear end side of the female terminal 20 is applied to the elastic member 30, the tongue pieces 34 fitted in the grooves 21*c* can function and stop the force so as to prevent the elastic member 30 from detaching from the rear end side of the female terminal 20.

Particularly, the tip end parts of the tongue pieces 34 have the same taper shape as the grooves 21*c* (see FIG. 3). That is, the tip end parts of the three tongue pieces 34 have a shape gradually expanding in a width direction, and when being bent at the right angle, the tongue pieces 34 have a shape expanding toward the outer side of the cylindrical portion 21. Particularly, a dimension of a first tongue piece 34*a* located at the uppermost position substantially matches a dimension of a groove 21*c*1 in which the first tongue piece 34*a* is fitted so that the elastic member 30 is prevented from falling downward. Further, since the remaining two tongue pieces 34*b* are located at positions nearly before 3 o'clock and after 9 o'clock on a clock in the front view (in FIG. 3), even if the elastic member 30 tends to fall downward, the two tongue pieces 34*b* and side surfaces 21*e* of the grooves 21*c* come into contact with each other, so that the elastic member 30 is prevented from falling downward.

As shown in FIGS. 1, 2 and 5, the elastic member 30 includes a substantially T-shaped cantilever member 35 extending from the second frame member 32 toward the rear end side of the elastic member 30. The cantilever member 35 includes a support member 35*a* linearly extending from a center of the second frame member 32 in the circumferential direction toward the rear end side of the elastic member 30, and a side member 35*b* extending to both side directions from the support member 35*a*. Incidentally, both end sides of the side member 35*b* are curved to the inner side of the cylindrical portion 21 according to a shape of the inner wall of the cylindrical portion 21. Accordingly, when attaching the elastic member 30 to the inner side of the cylindrical portion 21 (when inserting the elastic member 30 into the cylindrical portion 21), the side member 35*b* follows the shape of the inner wall of the cylindrical portion 21 and contributes to smooth attachment of the elastic member 30.

When the elastic member 30 is attached in the cylindrical portion 21, the side member 35*b* of the cantilever member 35 is close to (or in contact with) tip ends 21*f* of the two pillar members 21*d*. For this reason, even if the force toward the tip end side of the female terminal 20 is applied to the elastic member 30, the side member 35*b* comes into contact with the tip ends 21*f* of the two pillar members 21*d* so as to prevent the elastic member 30 from detaching from the tip end side.

Further, as shown in FIGS. 2 and 3, the rear end side projection portions 21*b* are wider than the tip end side projection portions 21*a* in the circumferential direction of the cylindrical portion 21, and a lower end (one side) of the second frame member 32 is close to (or in contact with) the rear end side projection portion 21*b* when the elastic member 30 is attached to the cylindrical portion 21. For this reason, even if the elastic member 30 tends to fall downward, the rear end side projection portion 21*b* supports the second frame member 32, so that the elastic member 30 is prevented from falling downward.

Next, a terminal connection by the terminal connecting structure 1 according to the present embodiment will be described.

First, the elastic member 30 is attached to the upper part of the cylindrical portion 21 of the female terminal 20. Then, the rod portion 11 of the male member 10 is inserted into the cylindrical portion 21 of the female terminal 20. Incidentally, the female terminal 20 attached with the elastic member 30 is accommodated in a terminal accommodating chamber of the connector. Further, the male terminal 10 is also accommodated in a terminal accommodating chamber of a mating connector.

Therefore, the rod portion 11 of the male terminal 10 is inserted into the cylindrical portion 21 of the female terminal 20 when the connectors are fitted to each other. During the insertion, the rod portion 11 comes into contact with the two tip end side projection portions 21*a* first, and then contacts the plurality of plate springs 33 of the elastic member 30. At this time, a contact load of the tip end side projection portions 21*a* on the rod portion 11 increases due to the wedge effect. However, in the present embodiment, the tip end of each of the tip end side projection portions 21*a* has a curved shape which is concave toward the outer side of the cylindrical portion 21. Further, the radius of curvature of the curved surface of the tip end of each of the tip end side projection portions 21*a* is larger than the radius of curvature of the circumferential surface of the rod portion 11. Therefore, the plating of the rod portion 11 is hardly scraped by the projection portions 21*a*, and the plating-scraping amount of the rod portion 11 is reduced.

Thereafter, as the rod portion 11 is further inserted into the cylindrical portion 21, the rod portion 11 comes into contact with the rear end side projection portions 21*b*. Like the tip end side projection portions 21*a*, the tip end of each of the rear end side projection portions 21*b* has a curved shape which is concave toward the outer side of the cylindrical portion 21. The radius of curvature of the curved surface of the tip end of each of the rear end side projection portions 21*b* is also larger than the radius of curvature of the circumferential surface of the rod portion 11. Therefore, the plating of the rod portion 11 is hardly scraped by the rear end side projection portions 21*b*, and the plating-scraping amount of the rod portion 11 is reduced.

In this way, according to the terminal connecting structure 1 and the female terminal 20 of the first embodiment, since the tip end of each of the projection portions 21*a*, 21*b* has the curved surface which is concave toward the outer side of the cylindrical portion 21, a surface pressure of the projection portions 21*a*, 21*b* on the rod portion 11 of the male terminal 10 can be lowered, and the plating-scraping amount of the rod portion 11 can be reduced accordingly when the male terminal 10 is inserted into the female terminal 20.

The radius of curvature of the curved surface of the tip end of each of the projection portions 21*a*, 21*b* is larger than the radius of curvature of circumferential surface of the rod portion 11. Here, if both of the radius of curvature of the curved surface of the tip end of each of the projection portions 21*a*, 21*b* and the radius of curvature of the circumferential surface of the rod portion 11 are designed to be the same for example, the radius of curvature of the curved surface of the tip end of each of the projection portions 21*a*, 21*b* may be smaller than the radius of curvature of the rod portion 11 due to dimensional tolerance. At this time, there is a concern that the tip end of each of the projection portions 21*a*, 21*b* acts like a sharp shape. However, since the radius of curvature of the curved surface of the tip end of each of the projection portions 21*a*, 21*b* is larger than the radius of curvature of the circumferential surface of the rod portion 11, such a concern does not occur and the plating-scraping amount of the rod portion 11 can be appropriately reduced.

The female terminal 20 has, on the front end face of the cylindrical portion 21, grooves 21*c* with a taper shape expanding in its width toward the outer side of the cylindrical portion 21. The elastic member 30 has tongue pieces 34 with a shape matching with grooves 21*c* on the front end face; and the tongue pieces 34 are bent so as to fit in the grooves 21*c*. Therefore, after the elastic member 30 is attached in the cylindrical portion 21, even if the force toward the rear end side of the female terminal 20 is applied to the elastic member 30, the tongue pieces 34 fitted in the grooves 21*c* can function so as to stop the force. Further, the grooves 21*c* have a taper shape expanding toward the outer side of the cylindrical portion 21 and the tongue pieces 34 have a shape matching with that of the grooves 21*c*, so that the elastic member 30 is restricted from moving to the lower side (one side) by the cooperation of the tongue pieces 34 and the tapered grooves 21*c*, and the elastic member 30 can hardly detach from the lower side (one side) of the cylindrical portion 21 even before the male terminal is inserted. Therefore, an assembling property of the elastic member 30 to the female terminal 20 can be improved.

The female terminal 20 has two pillar members 21*d* extending from the rear end face of the cylindrical portion 21 toward the rear end side, the elastic member 30 has the cantilever member 35 protruding toward the rear end side, and the side member 35*b* of the cantilever member 35 is in contact with or close to the tip ends 21*f* of the two pillar members 21*d*. With such a configuration, even if the force toward the tip end side of the female terminal 20 is applied to the elastic member 30, the side member 35*b* comes into contact with the pillar member 21*d* so as to stop the force. Therefore, the elastic member 30 can hardly detach from the tip end side, and the assembling property of the elastic member 30 to the female terminal 20 can be improved.

The second frame member 32 of the elastic member 30 is in contact with or close to the rear end side projection portion 21*b*. For this reason, the elastic member 30 is restricted from moving to the lower side by the rear end side projection portion 21*b*, and can hardly detach from the lower side of the cylindrical portion 21 even before the male terminal 10 is inserted. Therefore, an assembling property of the elastic member 30 to the female terminal 20 can be improved.

Next, a second embodiment of the present invention will be described. The terminal connecting structure according to the second embodiment is similar to that of the first embodiment, but a part of the configuration (the configuration of the female terminal 20 and the elastic member 30) is different. Hereinafter, differences between the two embodiments will be described.

Figure 6:
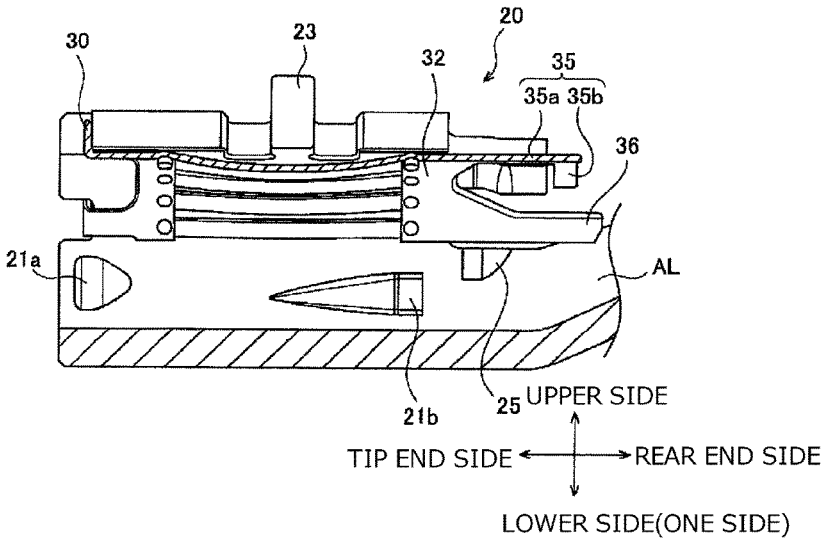
FIG. 6 is a cross-sectional view of the terminal connecting structure when an elastic member according to a second embodiment is attached in a cylindrical portion of a female terminal.

FIG. 6 is a cross-sectional view of the terminal connecting structure when the elastic member 30 according to the second embodiment is attached in the cylindrical portion 21 of the female terminal 20. As shown in FIG. 6, the elastic member 30 according to the second embodiment includes an extension portion 36 extending from the second frame member 32 toward the rear end side of the elastic member 30. Only one extension portion 36 is shown in FIG. 6, but two extension portions 36 are provided and each extends from both end portions of the second frame member 32 separately. The extension portions 36 extend further than the cantilever member 35 toward the rear end side, and tip ends of the extension portions 36 are configured to protrude further than the side member 35*b* toward the rear end side.

The female terminal 20 according to the second embodiment is different from the first embodiment in that the rear end side projection portions 21*b* have a width not wider than but substantially the same as the tip end side projection portions 21*a* in the circumferential direction. Further, the female terminal 20 has a protrusion 25 slightly above a rear end side of the rear end side projection portion 21*b*. Like the plurality of projection portions 21*a*, 21*b*, the projection portion 25 protrudes toward the inner side of the cylindrical portion 21. In FIG. 6, only one protrusion 25 is shown since only the left region AL of the female terminal 20 is shown, but the protrusion 25 is also provided in the left region AL. That is, the female terminal 20 has two protrusions 25.

Here, when the elastic member 30 is attached to the cylindrical portion 21, a lower part (one side) of the extension portion 36 is close to (or in contact with) the protrusion 25. For this reason, even if the elastic member 30 tends to fall downward, the protrusion 35 can support the elastic member 30 via the extension portion 36, so that the elastic member 30 is prevented from falling downward.

In this way, the terminal connecting structure 1 and the female terminal 20 according to the second embodiment can reduce the plating-scraping amount (appropriately) of the rod portion 11 as the first embodiment. Further, an assembling property of the elastic member 30 to the female terminal 20 can be improved.

According to the second embodiment, the elastic member 30 has the extension portion 36 extending from the second frame member 32 toward the rear end side of the elastic member 30, and the frame member 20 includes the protrusion 25 in contact with or close to the lower end of the extension portion 36. For this reason, the elastic member 30 is restricted from moving to the lower side by the cooperation of the extension portion 36 and the projection portion 25, and can hardly detach from the lower side of the cylindrical portion 21 even before the male terminal 10 is inserted. Therefore, an assembling property of the elastic member 30 to the female terminal 20 can be improved.

The present invention has been described based on the embodiments, but the present invention is not limited to the embodiments described above and can be appropriately modified without departing from the spirit of the present invention, and other technologies may be appropriately combined within a possible range.

For example, the terminal connecting structure 1 according to the embodiments includes two kinds of the projection portions 21*a*, 21*b* which are the tip end side projection portion 21*a* and the rear end side projection portion 21*b*, but the present invention is not limited thereto and the terminal connecting structure 1 may include only one of the projection portions or further include another kind of a projection portion as long as the rod portion 11 of the male terminal 10 can be held. The female terminal 20 includes two tip end side projection portions 21*a*, but the present invention is not limited thereto and three or more tip end side projection portions may be provided. The same applies to the rear end side projection portions 21*b*. In addition, although the two tip end side projection portions 21*a* are provided on the same cross section orthogonal to the axis of the cylindrical portion 21, they may also be deviated from the axial direction if possible. The same applies to the two rear end side projection portions 21*b*.

Three grooves 21*c* and three tongue pieces 34 are provided in the embodiments, but the present invention is not limited thereto and two or less, or four or more of them may be provided separately. Two pillar members 21*d* are provided, but one or three or more may be provided. In addition, the cantilever member 35 has a T shape as seen from the top, but the present invention is not limited thereto and the cantilever member 35 may have another shape such as an L shape.

In a case of attaching the elastic member 30 in the cylindrical portion 21, other methods may be used for the attachment instead of using the tongue pieces 34. Further, the elastic member 20 is not limited to be attached to the upper side in the cylindrical portion 21, but may also be attached to other positions such as a lower side of the terminal connecting structure.

What is claimed is:

1. A terminal connecting structure comprising:

a male terminal having a plated columnar rod portion;

a female terminal having a cylindrical portion defining cavity configured to receive the rod portion of the male terminal therein; and an elastic member attached to the cylindrical portion of the female terminal, wherein the elastic member energizes the rod portion of the male terminal toward a central portion of an inner surface of the cylindrical portion when the rod portion of the male terminal is inserted into the cylindrical portion of the female terminal;

wherein the female terminal has a plurality of projection portions protruding inward from respective regions located at only both sides of the central portion of the inner surface of the cylindrical portion as seen from a front view; and wherein a tip end of each of the plurality of projection portions has a curved surface which is inwardly concave toward the cavity defined by the cylindrical portion according to a circumferential shape of the rod portion of the male terminal.

2. The terminal connecting structure according to claim 1, wherein a radius of curvature of the curved surface of the tip end of each of the projection portion is larger than a radius of curvature of a circumferential surface of the rod portion of the male terminal in a cross section orthogonal to an axis of the cylindrical portion.

3. The terminal connecting structure according to claim 1, wherein the elastic member includes two half-ring-shaped frame members spaced apart from each other and located on a tip end side and a rear end side of the cylindrical portion, and includes a plurality of plate springs curved inward of the cylindrical portion and connecting the two frame members;

wherein the plurality of projection portions include two or more projection portions provided at the tip end side and the rear end side of the cylindrical portion respectively; and wherein the frame member on the rear end side is in contact with or close to the projection portion on the rear end side of the cylindrical portion of the female terminal.

4. The terminal connecting structure according to claim 3, wherein a width of the projection portions provided at the tip end side is larger than that of the projection portions provided at the rear end side in a peripheral direction of the cylindrical portion.

5. The terminal connecting structure according to claim 1, wherein a front end face of the cylindrical portion has a groove extending toward an outer side of the cylindrical portion while expanding a width of the groove;

wherein the elastic member has a tongue piece with a shape matching with the groove; and wherein the tongue piece is configured to be fit in the groove.

6. A female terminal comprising:

a cylindrical portion defining a cavity configured to receive a plated columnar rod portion of a male terminal; and a plurality of projection portions protruding inward from respective regions located at only both sides of a central portion of an inner surface of the cylindrical portion as seen from a front view, wherein when an elastic member is attached to the cylindrical portion of the female terminal and the rod portion of the male terminal is inserted into the cylindrical portion of the female terminal, the elastic member energizes the rod portion of the male terminal toward the central portion of the inner surface of the cylindrical portion; and wherein a tip end of each of the plurality of projection portions has a curved surface which is inwardly concave toward the cavity defined by the cylindrical portion according to a circumferential shape of the rod portion of the male terminal.

7. A terminal connecting structure comprising:

a male terminal having a plated columnar rod portion;

a female terminal having a cylindrical portion configured to receive the rod portion of the male terminal therein; and an elastic member attached to the cylindrical portion of the female terminal, wherein the elastic member energizes the rod portion of the male terminal toward an inner surface of the cylindrical portion when the rod portion of the male terminal is inserted into the cylindrical portion of the female terminal;

wherein the female terminal has a plurality of projection portions protruding inward from respective regions located at both sides of a central portion of the inner surface of the cylindrical portion as seen from a front view, wherein a tip end of each of the plurality of projection portions has a curved surface which is concave toward an outer side of the cylindrical portion, wherein the elastic member includes two half-ring-shaped frame members spaced apart from each other and located on a tip end side and a rear end side of the cylindrical portion, and includes a plurality of plate springs curved inward of the cylindrical portion and connecting the two frame members, wherein the plurality of projection portions include two or more projection portions provided at the tip end side and the rear end side of the cylindrical portion respectively, and wherein the frame member on the rear end side is in contact with or close to the projection portion on the rear end side of the cylindrical portion of the female terminal.

8. The terminal connecting structure according to claim 7, wherein a width of the projection portions provided at the tip end side is larger than that of the projection portions provided at the rear end side in a peripheral direction of the cylindrical portion.

* * * * *